US010520290B2

(12) United States Patent
Pinoteau et al.

(10) Patent No.: US 10,520,290 B2
(45) Date of Patent: Dec. 31, 2019

(54) PROJECTILE

(71) Applicant: NEXTER MUNITIONS, Versailles (FR)

(72) Inventors: Sylvain Pinoteau, Touchay (FR); Quentin Morvan, Bourges (FR); Hervé Vacher, Foecy (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 16/199,989

(22) Filed: Nov. 26, 2018

(65) Prior Publication Data

US 2019/0162512 A1 May 30, 2019

(30) Foreign Application Priority Data

Nov. 24, 2017 (FR) ..... 17 01228

(51) Int. Cl.
*F42B 14/06* (2006.01)
*F42B 14/02* (2006.01)

(52) U.S. Cl.
CPC ..... *F42B 14/064* (2013.01); *F42B 14/02* (2013.01); *F42B 14/067* (2013.01)

(58) Field of Classification Search
CPC ..... F42B 14/06; F42B 14/064; F42B 14/067
USPC ..... 102/521, 522, 523
See application file for complete search history.

(56) References Cited

U.S. PATENT DOCUMENTS 3,738,279 A * 6/1973 Eyre ..... F42B 14/02 102/521
3,927,618 A * 12/1975 Engel ..... F42B 14/064 102/522
2010/0000439 A1* 1/2010 Baumann ..... F42B 5/18 102/521
2013/0284045 A1 10/2013 Lee
2015/0330755 A1 11/2015 Citro et al.

FOREIGN PATENT DOCUMENTS

DE 2407220 A1 * 9/1980 ..... F42B 14/061
EP 1 297 292 B1 4/2010

OTHER PUBLICATIONS

Jul. 9, 2018 Search Report issued in French Patent Application FR1701228.
Jul. 9, 2018 Written Opinion issued in French Patent Application FR 1701228.

* cited by examiner

*Primary Examiner* — Stephen Johnson
(74) *Attorney, Agent, or Firm* — Oliff PLC

(57) ABSTRACT

A projectile includes an ejectable cup intended to protect a base of the projectile from propulsion gases, the cup including a wall surrounding the base and extending to a position where the edge of the wall is pinched between a seal surrounding the body of the projectile and a collar, including an annular part centered on a first cylindrical seat having a first diameter. The first seat is separated from a second seat by a shoulder, the face of which is oriented toward the rear of the projectile, a gripping means pressing the seal against the annular part, which causes the radial expansion of the seal, pressing it against the edge of the cup.

12 Claims, 5 Drawing Sheets

PROJECTILE

The technical field of the invention relates to projectiles including a rotating band and a rear cup that is intended to be released on a trajectory.

BACKGROUND

One known projectile 1 of this type is shown in FIGS. 1*a* to 1*c*. It includes a cup 5 that is intended to contain and protect a tail fin assembly of the projectile 1 during the storage and transport operations, and above all during the gun firing phase of the projectile.

A rotating band 3 of the projectile is there to provide sealing against gases between the projectile and the gun during firing of the projectile.

In order to protect the contents of the cup 5 from the corrosive effects of the firing gases, it is known to use a collar 4 that is centered by an annular part 4*a* on the projectile. The cup 5 comprises a wall 5*b* that extends from the bottom of the cup to below the collar 4.

An O-ring 8 is centered on the body 2 of the projectile 1 and pinches the edge of the wall 5*b* against the inside of the collar 4.

In this way, the firing gases cannot penetrate the cup 5 at the edge 5*c* of the wall 5*b*.

Upon leaving the gun, the shell 5 is separated from the rest of the projectile by means known by the person skilled in the art and as disclosed in patent EP 1,297,292, for example.

The rotating band 3 is in turn dislocated due to the rotation of the projectile, which improves the overall aerodynamics of the projectile by reducing the surface opposing the forward motion.

However, it remains an aerodynamic brake formed by a bulge of the projectile 1 body 2. This bulge forms a shoulder oriented toward the front of the projectile to serve as support for the annular part 4*a* of the collar 4.

It forms a first obstacle to the flow of air. The bulge includes a groove 7 that receives the O-ring 8, this groove causes a discontinuity in the flow of air (FIG. 1*c*), which forms a second aerodynamic brake and thus limits the range of the projectile.

Patent EP 1,297,292 describes one such type of known projectile.

SUMMARY

The invention aims to improve the range of the projectile by reducing the sources of aerodynamic braking.

Thus, the invention relates to a projectile including an ejectable cup intended to protect, during firing, a base of the projectile with respect to propulsion gases, the cup including a bottom located at a rear of the projectile and a wall surrounding the base and extending longitudinally to a position where an edge of the wall is pinched between a seal surrounding a body of the projectile and a collar also surrounding the projectile, the collar comprising an annular part centered on a first cylindrical seat of the body of the projectile, the first cylindrical seat having a first diameter, the collar being located behind a rotating band of the projectile that is centered on a second cylindrical seat of the body of the projectile, the second cylindrical seat having a second diameter, wherein the first cylindrical seat is separated from the second cylindrical seat by a shoulder, a face of which is oriented toward the rear of the projectile, a gripping means pressing the seal against the annular part of the collar, which causes the radial expansion of the seal, which is thus pressed against the edge of the cup, which is in turn pressed against an inside of the collar.

Advantageously, the gripping means includes a nut screwed on a thread centered on the projectile body, the thread having an outer diameter that is less than or equal to the first diameter, the nut being able to be fragmented by the action of centrifugal forces developed during firing.

Advantageously, the seal includes at least one axial stack of resilient rings.

Advantageously, each resilient ring is made up of an assembly of a plurality of contiguous sectors, the junctions of which are distributed angularly evenly and such that, for a first ring, the junction zones are angularly offset relative to the junction zones of a second adjacent ring.

Advantageously, the collar is made up of the assembly of a plurality of contiguous sectors, the junctions of which are distributed angularly evenly, the annular part of the collar is located across from the inside of the collar, thus forming a chute capable of matching the edge of the cup, and is located partially between the edge of the cup and the projectile body, which prevents the radial separation from the collar.

BRIEF DESCRIPTION OF THE DRAWINGS

The invention will be better understood upon reading the following description, done with reference to the appended drawings, in which drawings.

DETAILED DESCRIPTION OF EMBODIMENTS

Figure 1A:
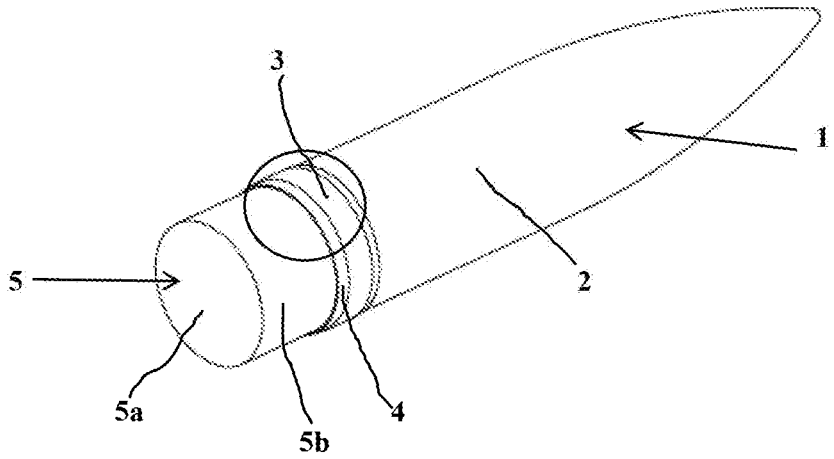
FIG. 1*a* shows a rear three-quarters view of a projectile according to the prior art.
Figure 1B:
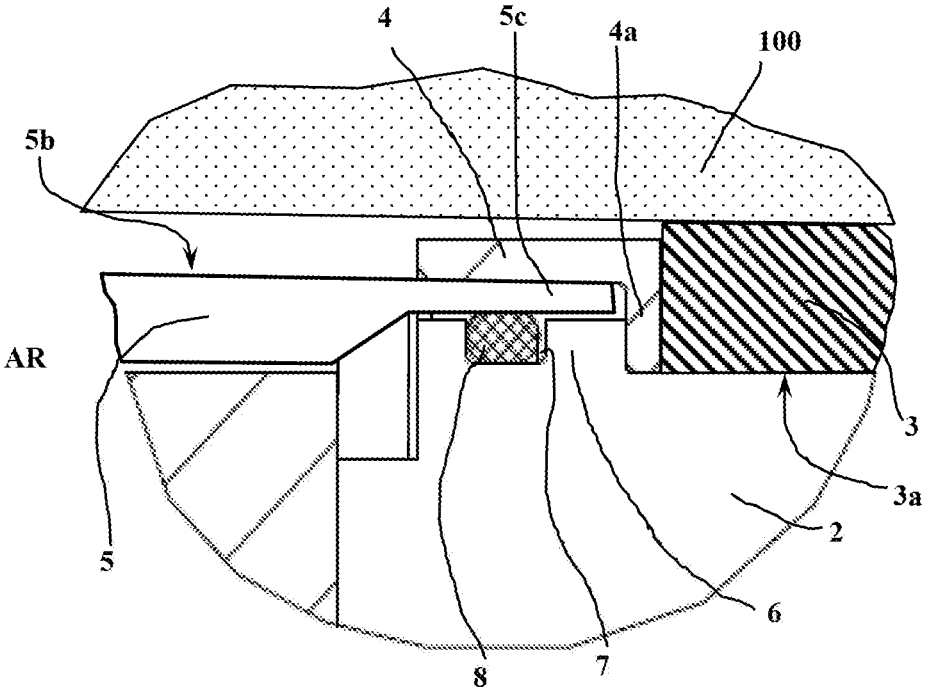
FIG. 1*b* shows a longitudinal sectional detail view of a projectile according to the prior art, positioned in a gun, the illustrated detail is identified by a circle in FIG. 1*a*.
Figure 1C:
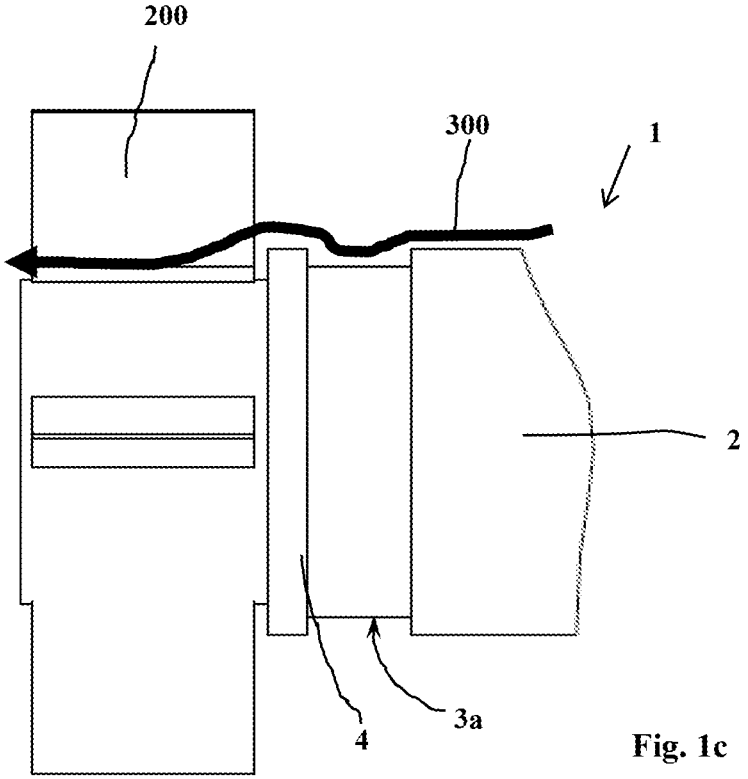
FIG. 1*c* shows a view of the rear part of a projectile according to the prior art under flight conditions.

As outlined in the preamble, FIGS. 1*a*, 1*b* and 1*c* show a projectile according to the Prior Art.

According to FIG. 1*a*, a projectile 1 includes a projectile body 2 surrounded by a rotating band 3 arranged in a groove 3*a*. The rear of the projectile 1 body 2 is contained in a cup 5 that includes a bottom 5*a* and a wall 5*b* that surrounds the rear of the projectile body 2 and extends from the bottom 5*a* to beneath a collar 4 located behind the rotating band 3.

According to FIG. 1*b*, the collar 4 includes an annular part 4*a* centered on the body of the projectile 1 and leaning on the rotating band 3. It will be recalled that the rotating band 3 serves to seal the connection between the projectile 1 and the inner wall of a gun 100 so that the propulsion gases stay behind the projectile and do not leak around the projectile.

According to the prior art, the projectile thus includes a circular bulge 6 including a groove 7 that receives an O-ring 8. The edge 5*c* of the wall 5*b* of the cup 5 passes below the collar 4 and is pinched between the O-ring 8 and the inner face of the collar 4.

Thus, when the projectile is in the gun, the gases cannot infiltrate the inside of the cup 5 by crossing the edge 5*c*.

After firing, once the projectile has left the gun as illustrated on FIG. 1*c*, the cup 5 is released using means known by the person skilled in the art, like those disclosed in patent EP 1,297,292 and which are not the subject matter of the present invention.

The rotating band 3 is also no longer held by the tube of the weapon and is separated by the rotation of the projectile 1. The collar 4 remains in place as shown in FIG. 1*c*, behind the groove 3*a* that was receiving the rotating band.

The rear of the projectile 1 is then freed and the fins 200 serving to increase the range of the projectile 1 can deploy (here the fins are formed by metal sheets wound around the rear of the projectile and which deploy resiliently).

It nevertheless remains the bulge 6 covered by the collar 4 that forms a protruding obstacle frontally opposing the penetration in the air of the projectile by disrupting the flow 300 of air along the profile of the projectile 1, which is detrimental to its range.

Figure 2A:
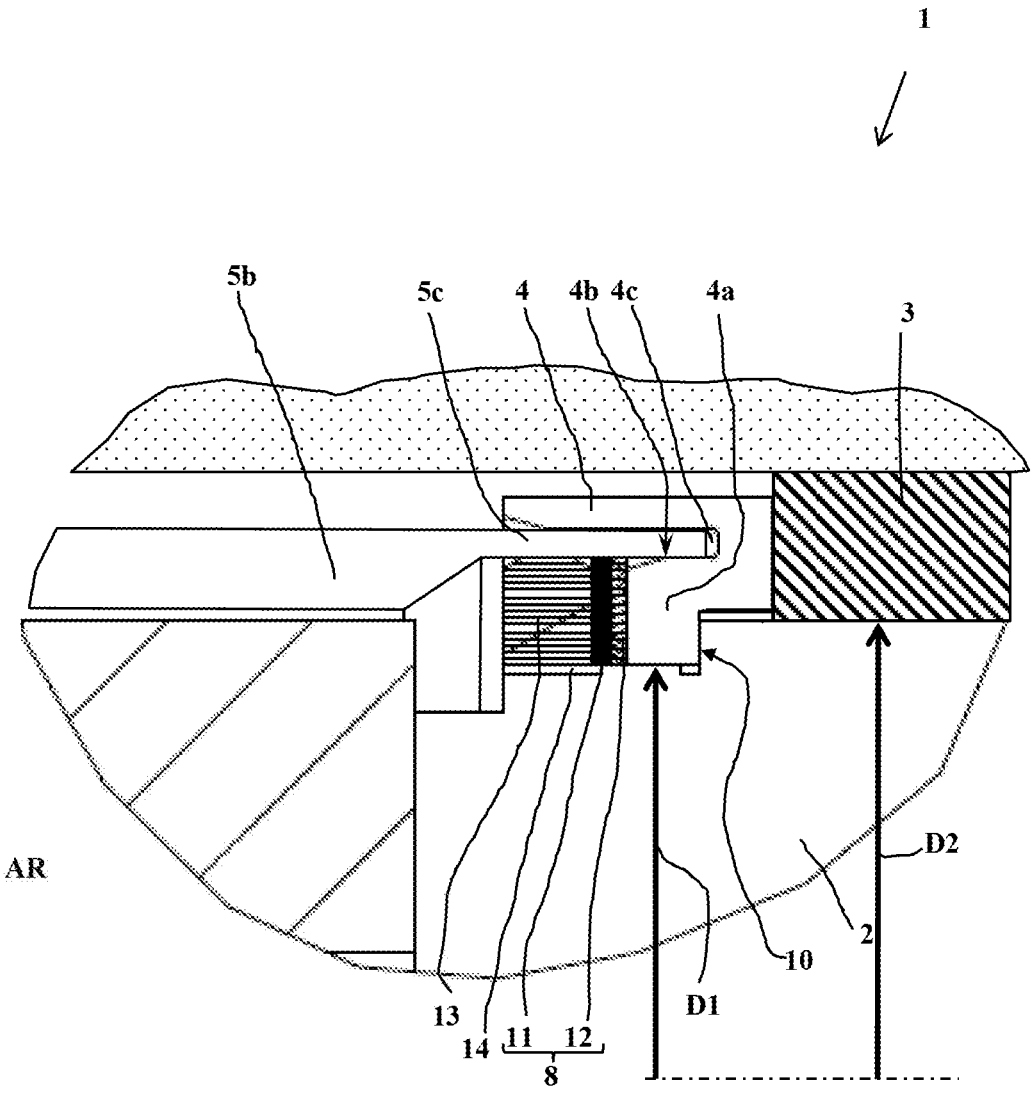
FIG. 2*a* shows a longitudinal sectional detail view of a projectile according to the invention positioned in a gun.
Figure 2B:
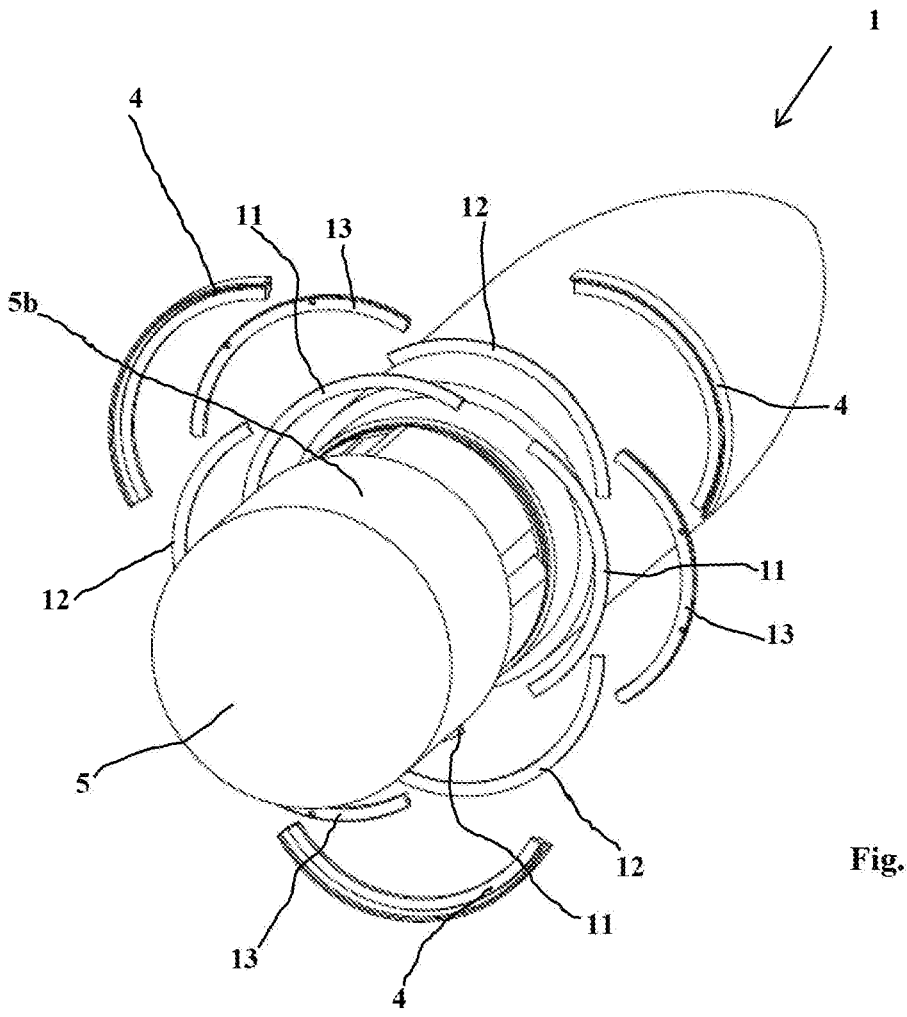
FIG. 2*b* shows a rear three-quarters view of a projectile according to the invention during the release of a cup.
Figure 2C:
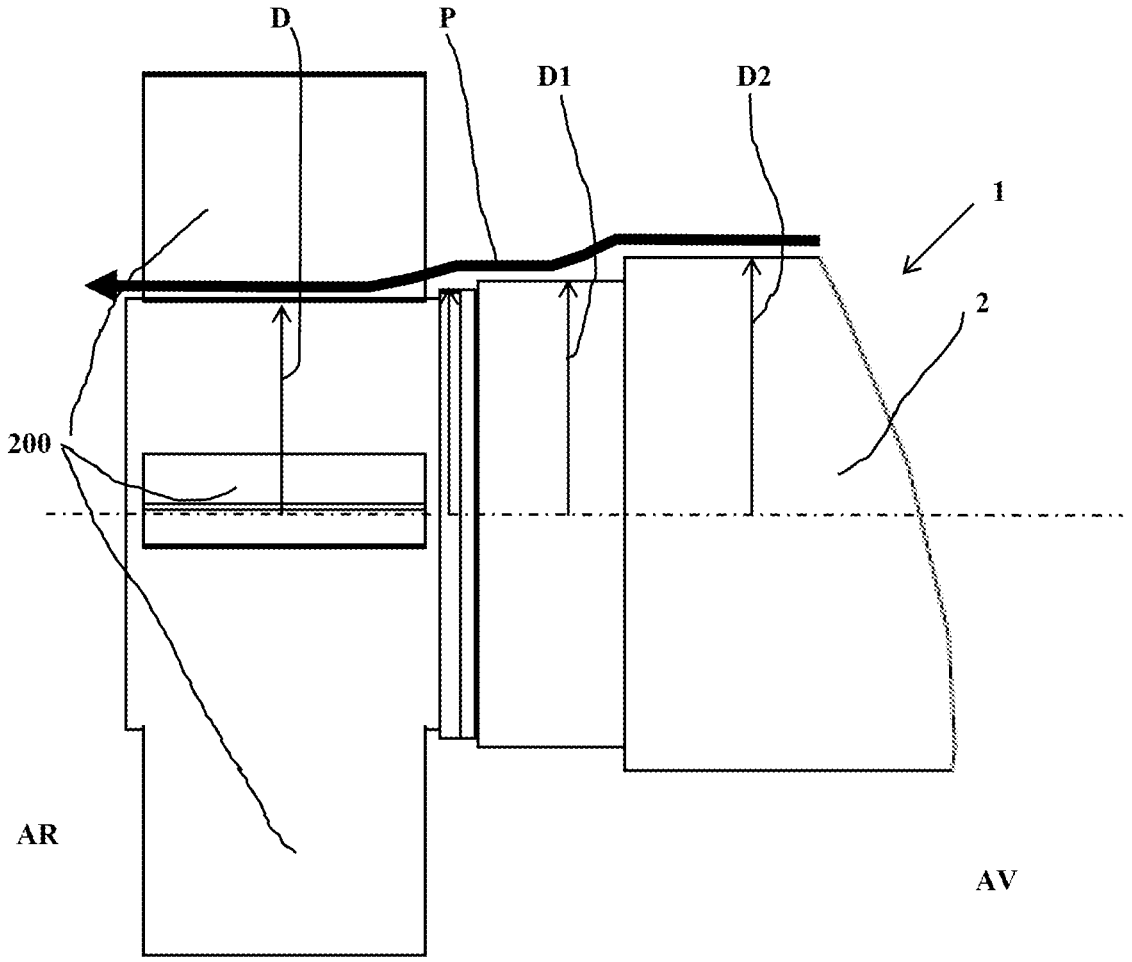
FIG. 2*c* shows a view of the rear part of a projectile according to the invention under flight conditions.

FIGS. 2*a*, 2*b* and 2*c* show a projectile according to one embodiment of the invention.

According to FIG. 2*a*, the projectile 1 includes a cup 5, the edge 5*c* of the wall 5*b* of which is located below a collar 4, and between the collar 4 and a seal 8 located on the projectile body. The collar 4 includes an annular part 4*a* that is centered on a first cylindrical seat of the body 2 of the projectile, which has a first diameter D1, and that is leaning on a rotating band 3 in turn centered on a second cylindrical seat of the projectile body 2 that has a second diameter D2.

The first diameter D1 is smaller than the second diameter D2 so as to form a shoulder 10 whereof the annular face is oriented toward the rear AR of the projectile 1.

A pair of resilient rings 11 and 12 stacked axially forms the seal 8, guaranteeing that the propulsion gases do not pass between the collar 4 and the edge 5*c* of the cup 5.

The resilient rings 11 and 12 are crushed against the annular part 4*a* of the collar 4 by a gripping means 13 including a nut screwed on a thread 14 formed on the first diameter D1 of the projectile body, the gripping means including a nut 13.

Pressure exerted by the gripping means 13 causes the radial expansion of the resilient rings 11 and 12, which are compressed against the edge 5*c* of the shell 5, which in turn is pressed against the inside of the collar 4.

The person skilled in the art will understand that the resilient rings 11 and 12 can be replaced by an O-ring.

The sealing thus done prevents the propulsion gases from crossing the edge 5*c* of the cup.

For reasons mentioned later, the collar 4 and its annular part 4*a* are made up of several sectors contiguous in pairs, the junctions of which are angularly evenly distributed. In order to keep these sectors joined, the annular part 4*a* of the collar 4 is located across from the inside of the collar 4, thus forming a chute 4*c* able to correspond to the edge 5*c* of the cup 5. This annular part 4*a* according to the invention is therefore located partially between the edge 5*c* of the shell 5 and the projectile body 2, which prevents the radial separation of the collar 4 owing to the edge 5*c* of the shell 5, which opposes any radial movement of the inner part 4*b* of the collar 4. Likewise, the resilient rings 11 and 12 include sectors contiguous in pairs, the junctions of which are angularly evenly distributed. Owing to the edge 5*c* of the cup, any radial movement of the ring sectors 11 and 12 is blocked, which maintains the integrity of the resilient rings.

According to FIG. 2*b*, upon leaving the barrel of the weapon (barrel not shown), the cup 5 slides toward the rear of the projectile 1 until it is released. One can see that once the edge 5*c* of the wall 5*a* of the shell 5 is removed from beneath the collar 4, the latter is no longer radially retained and the various sectors of the collar 4 separate from the projectile 1 through the combined effect of the centrifugal force and aerodynamic stresses experienced by the collar 4.

The same is true for the resilient ring sectors 11 and 12 forming the seal 8.

One can see in this view that the junctions of each ring sector of a first ring 11 are axially offset relative to the junctions of the sectors of the second adjacent ring 12 such that each junction is across from an adjacent ring sector to improve the sealing provided by the ring sectors 11 and 12.

The gripping means 13 includes fragmentation lines that allow it to burst under the centrifugal force once the collar 4 is released.

According to FIG. 2*c*, the shell 5 has been released and the collar ring sectors no longer retained by the edge 5*b* of the shell 5 have been dispersed as well as the gripping means (cup, rings and collar not shown).

The fins 200 are deployed. It will be noted that the projectile body 2 exposes, in the order of travel P of air along its profile, the second seat having a second diameter D2 greater than the first diameter D1 of the first seat and that all of the following changes in diameter D moving toward the rear AR of the projectile 1 have decreasing dimensions, which makes it possible not to oppose frontal resistance to the flow P of air, and therefore to the penetration of the projectile 1 in the air.

The invention therefore makes it possible not to reduce the range, unlike the solution according to the prior art, and the rear part of the projectile nevertheless remains protected from the gases during the gun firing phase.

The invention claimed is:

1. A projectile including an ejectable cup intended to protect, during firing, a base of the projectile with respect to propulsion gases, the cup including a bottom located at a rear of the projectile and a wall surrounding the base and extending longitudinally to a position where an edge of the wall is pinched between a seal surrounding a body of the projectile and a collar also surrounding the projectile, the collar comprising an annular part centered on a first cylindrical seat of the body of the projectile, the first cylindrical seat having a first diameter, the collar being located behind a rotating band of the projectile that is centered on a second cylindrical seat of the body of the projectile, the second cylindrical seat having a second diameter, wherein the first cylindrical seat is separated from the second cylindrical seat by a shoulder, a face of which is oriented toward the rear of the projectile, a means for gripping pressing the seal against the annular part of the collar, which causes a radial expansion of the seal, which is thus pressed against the edge of the cup, which is in turn pressed against an inside of the collar.

2. The projectile according to claim 1, wherein the means for gripping includes a nut screwed on a thread centered on the projectile body, the thread having an outer diameter that is less than or equal to the first diameter, the nut being able to be fragmented by an action of centrifugal forces developed during firing.

3. The projectile according to claim 1, wherein the seal includes at least one axial stack of resilient rings.

4. The projectile according to claim 3, wherein each resilient ring is made up of an assembly of a plurality of contiguous sectors, junctions of which are distributed angularly evenly and such that, for a first ring, junction zones are angularly offset relative to junction zones of a second adjacent ring.

5. The projectile according to claim 2, wherein the seal includes at least one axial stack of resilient rings.

6. The projectile according to claim 5, wherein each resilient ring is made up of an assembly of a plurality of contiguous sectors, junctions of which are distributed angularly evenly and such that, for a first ring, junction zones are angularly offset relative to junction zones of a second adjacent ring.

7. The projectile according to any claim 1, wherein the collar is made up of the assembly of a plurality of contiguous sectors, junctions of which are distributed angularly evenly, the annular part of the collar is located across from the inside of the collar, thus forming a chute capable of matching an edge of a shell, and is located partially between the edge of the cup and the projectile body, which prevents a radial separation from the collar.

8. The projectile according to any claim 2, wherein the collar is made up of the assembly of a plurality of contiguous sectors, junctions of which are distributed angularly evenly, the annular part of the collar is located across from the inside of the collar, thus forming a chute capable of matching the edge of the shell, and is located partially between the edge of the cup and the projectile body, which prevents a radial separation from the collar.

9. The projectile according to any claim 3, wherein the collar is made up of the assembly of a plurality of contiguous sectors, junctions of which are distributed angularly evenly, the annular part of the collar is located across from the inside of the collar, thus forming a chute capable of matching the edge of the shell, and is located partially between the edge of the cup and the projectile body, which prevents a radial separation from the collar.

10. The projectile according to any claim 4, wherein the collar is made up of the assembly of a plurality of contiguous sectors, junctions of which are distributed angularly evenly, the annular part of the collar is located across from the inside of the collar, thus forming a chute capable of matching the edge of the shell, and is located partially between the edge of the cup and the projectile body, which prevents a radial separation from the collar.

11. The projectile according to any claim 5, wherein the collar is made up of the assembly of a plurality of contiguous sectors, junctions of which are distributed angularly evenly, the annular part of the collar is located across from the inside of the collar, thus forming a chute capable of matching the edge of the shell, and is located partially between the edge of the cup and the projectile body, which prevents a radial separation from the collar.

12. The projectile according to any claim 6, wherein the collar is made up of the assembly of a plurality of contiguous sectors, junctions of which are distributed angularly evenly, the annular part of the collar is located across from the inside of the collar, thus forming a chute capable of matching the edge of the shell, and is located partially between the edge of the cup and the projectile body, which prevents a radial separation from the collar.

* * * * *